US006276646B1

(12) United States Patent
Gaba

(10) Patent No.: US 6,276,646 B1
(45) Date of Patent: Aug. 21, 2001

(54) SUPPORT ASSEMBLY

(76) Inventor: Albert M. Gaba, 11122 Sagittarius Rd., San Diego, CA (US) 92126-1842

( * ) Notice: Subject to any disclaimer, the term of this patent is extended or adjusted under 35 U.S.C. 154(b) by 0 days.

(21) Appl. No.: 09/687,082

(22) Filed: Oct. 13, 2000

(51) Int. Cl.[7] ..... B68G 5/00

(52) U.S. Cl. ..... 248/118; 248/231.61; 248/918; 108/152

(58) Field of Search ..... 248/118, 118.1, 248/231.61, 918; 108/17, 65, 159.11, 157.12, 157.13, 157.18, 69, 152, 50.01, 77, 93

(56) References Cited

U.S. PATENT DOCUMENTS 329,140 * 10/1885 Clarke ..... 248/118
1,644,441 * 4/1927 O'Brien ..... 248/118
5,320,313 * 6/1994 Crowe ..... 248/918 X
5,975,469 * 11/1999 Chen ..... 248/118.1
6,109,571 * 8/2000 Hirschovits et al. ..... 248/118

* cited by examiner

*Primary Examiner*—Ramon O. Ramirez
*Assistant Examiner*—Korie H. Chan

(57) ABSTRACT

A support assembly for providing arm support while using computer input devices. The support assembly includes a first panel with a mounting edge and a coupling edge, a second panel hingably coupled to the first panel adjacent to the coupling edge of the first panel such that the second panel forms an extension for the first panel, and a third panel in a spaced parallel relationship with the first panel such that the first and third panels selectively engage a worktop.

6 Claims, 2 Drawing Sheets

SUPPORT ASSEMBLY

BACKGROUND OF THE INVENTION

1. Field of the Invention

The present invention relates to support panels and more particularly pertains to a new support assembly for providing arm support while using computer input devices.

2. Description of the Prior Art

The use of support panels is known in the prior art. More specifically, support panels heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 5,876,002; 5,351,897; 5,402,972; 2,477,898; 259,390; and U.S. Pat. No. Des. 382,849.

While these devices fulfill their respective, particular objectives and requirements, the aforementioned patents do not disclose a new support assembly. The inventive device includes a first panel with a mounting edge and a coupling edge, a second panel hingably coupled to the first panel adjacent to the coupling edge of the first panel such that the second panel forms an extension for the first panel, and a third panel in a spaced parallel relationship with the first panel such that the first and third panels selectively engage a worktop.

In these respects, the support assembly according to the present invention substantially departs from the conventional concepts and designs of the prior art, and in so doing provides an apparatus primarily developed for the purpose of providing arm support while using computer input devices.

SUMMARY OF THE INVENTION

In view of the foregoing disadvantages inherent in the known types of support panels now present in the prior art, the present invention provides a new support assembly construction wherein the same can be utilized for providing arm support while using computer input devices.

The general purpose of the present invention, which will be described subsequently in greater detail, is to provide a new support assembly apparatus and method which has many of the advantages of the support panels mentioned heretofore and many novel features that result in a new support assembly which is not anticipated, rendered obvious, suggested, or even implied by any of the prior art support panels, either alone or in any combination thereof.

To attain this, the present invention generally comprises a first panel with a mounting edge and a coupling edge, a second panel hingably coupled to the first panel adjacent to the coupling edge of the first panel such that the second panel forms an extension for the first panel, and a third panel in a spaced parallel relationship with the first panel such that the first and third panels selectively engage a worktop.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new support assembly apparatus and method which has many of the advantages of the support panels mentioned heretofore and many novel features that result in a new support assembly which is not anticipated, rendered obvious, suggested, or even implied by any of the prior art support panels, either alone or in any combination thereof.

It is another object of the present invention to provide a new support assembly which may be easily and efficiently manufactured and marketed.

It is a further object of the present invention to provide a new support assembly which is of a durable and reliable construction.

An even further object of the present invention is to provide a new support assembly which is susceptible of a low cost of manufacture with regard to both materials and labor, and which accordingly is then susceptible of low prices of sale to the consuming public, thereby making such support assembly economically available to the buying public.

Still yet another object of the present invention is to provide a new support assembly which provides in the apparatuses and methods of the prior art some of the advantages thereof, while simultaneously overcoming some of the disadvantages normally associated therewith.

Still another object of the present invention is to provide a new support assembly for providing arm support while using computer input devices.

Yet another object of the present invention is to provide a new support assembly which includes a first panel with a mounting edge and a coupling edge, a second panel hingably coupled to the first panel adjacent to the coupling edge of the first panel such that the second panel forms an extension for the first panel, and a third panel in a spaced parallel relationship with the first panel such that the first and third panels selectively engage a worktop.

Still yet another object of the present invention is to provide a new support assembly that can be mounted to virtually any worktop.

Even still another object of the present invention is to provide a new support assembly that minimizes arm stress and fatigue.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
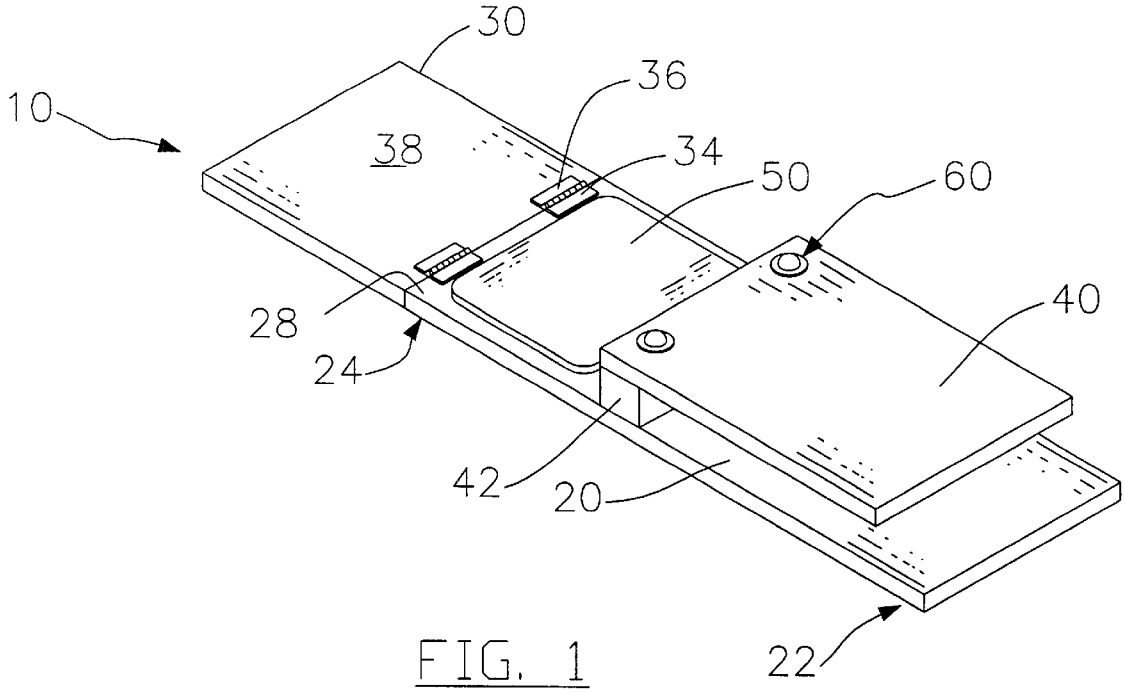
FIG. 1 is a schematic perspective view of a new support assembly according to the present invention.
Figure 2:
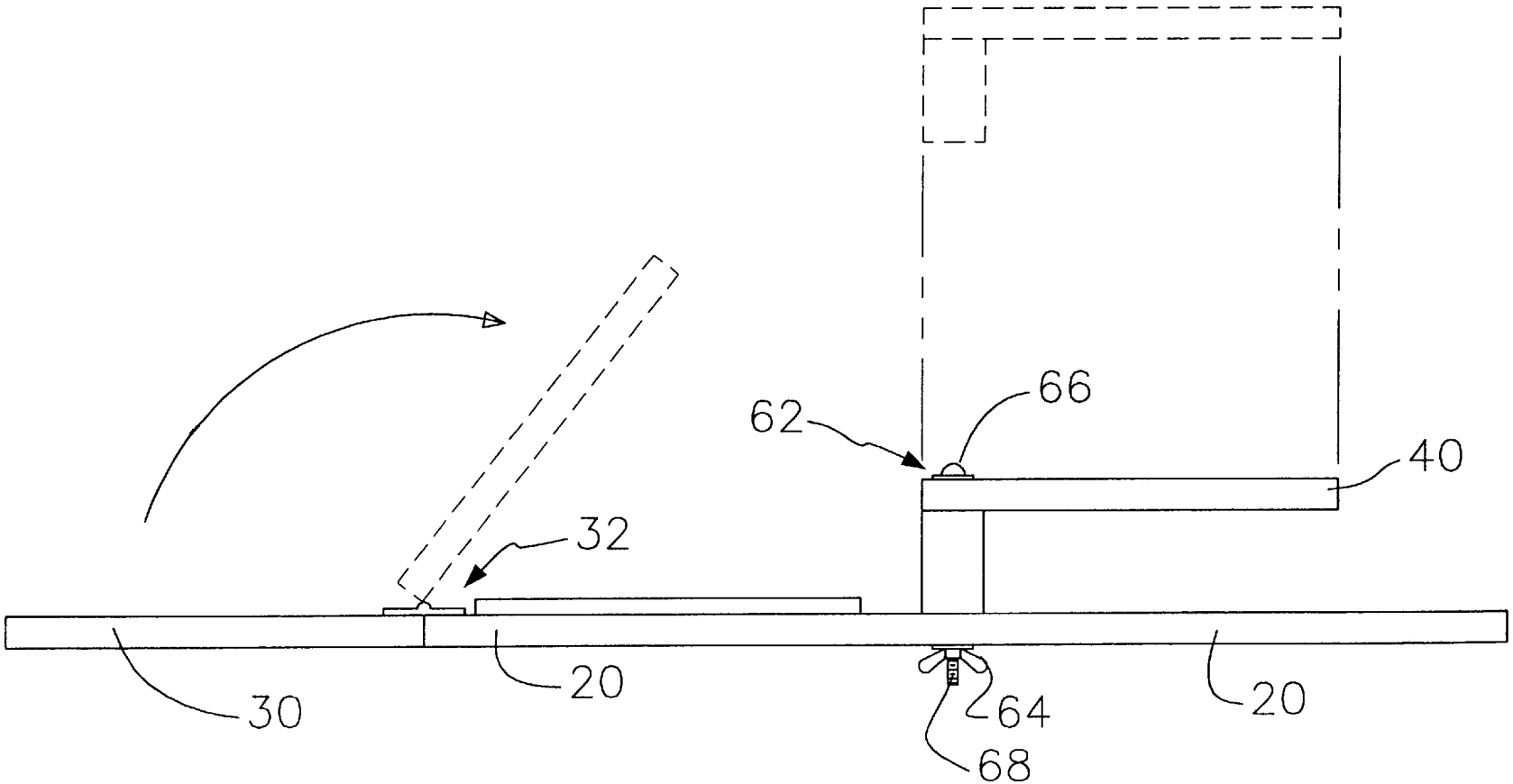
FIG. 2 is a schematic side view of the present invention.

With reference now to the drawings, and in particular to FIGS. 1 through 2 thereof, a new support assembly embodying the principles and concepts of the present invention and generally designated by the reference numeral 10 will be described.

As best illustrated in FIGS. 1 through 2, the support assembly 10 generally comprises a first panel 20, a second panel 30, and a third panel 40.

The first panel 20 includes a mounting edge 22 and a coupling edge 24. The second panel 30 is hingably coupled to the coupling edge 24 of the first panel 20. The second panel 30 is an extension for the first panel 20.

The third panel 40 is positioned in a spaced generally parallel relationship with the first panel 20 such that the support assembly 10 engages a worktop.

Each of a pair of hinges 32 includes a first portion 34 and a second portion 36. The first portion 34 is coupled to a top surface 28 of the coupling edge 24 of the first panel 20. The second portion 36 is coupled to a top surface 38 of the second panel 30. The pair of hinges 32 is for pivotally coupling the first panel 20 and the second panel 30.

A spacer member 42 rests upon a medial portion of the first panel 20. The spacer member 42 includes a plurality of apertures.

The third panel 40 includes a plurality of third panel apertures. Each of the plurality of third panel apertures is positioned adjacent to a first end of the third panel 40. Each of the plurality of third panel apertures is aligned with an associated one of apertures of the spacer member 42.

Each one of a plurality of connection apparati 60 is received by an associated one of the plurality of apertures and third panel apertures. The connection apparati 60 provide a clamping force between the first panel 20 and the third panel 40 through the spacer member 42.

In an embodiment the connection apparati 60 comprises a threaded member 62 and a nut member 64. The threaded member 62 includes a head portion 66 and a shaft portion 68. The threaded member 62 is insertable in an associated one of the third panel apertures, an associated one of the apertures of the spacer member 42. The head portion 66 includes a diameter larger than each of the third panel apertures. The head portion 66 supports the shaft portion 68 when the threaded member 62 is received by the apertures. The threaded member 62 includes an exterior surface with threads thereon. The nut member 64 includes a perimeter wall with an aperture. The aperture has threads applied onto it. The nut member 64 is for selectively capturing the threaded member 62 in an associated pairing of aperture, and third panel aperture.

A pad member 50 is positioned on a top surface 28 of the first panel 20 adjacent the coupling end 24. The pad member 50 is designed for providing an actuation surface for a mouse type input device.

In an embodiment the first panel 20 includes a length of approximately 26 inches. The second panel 30 includes a length of approximately 10 inches. The third panel 40 includes a length of approximately 10 inches. The third panel 40 is positioned substantially 2.5 inches above the first panel 20.

In use, the assembly is positioned such that a bottom surface of the third panel rests on a top surface of a worktop and a top surface of the first panel abuts a bottom surface of the worktop. The connecting apparati are tightened such that the first and third panels snuggly hold the worktop. The second panel is pivoted with respect to the first panel to form and extension for the first panel.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A support assembly comprising:

a first panel, said first panel having a mounting edge and a coupling edge, said first panel having a plurality of slots;

a second panel, said second panel being hingably coupled to said coupling edge of said first panel such that the second panel can be folded on top of the first panel and below the third panel, said second panel being an extension for said first panel;

a third panel, said third panel being positioned in a spaced generally parallel relationship with said first panel such that said support assembly engaging a worktop;

a spacer member, said spacer member resting upon an medial portion of said first panel, said spacer member having a plurality of apertures;

said third panel having a plurality of third panel apertures, each of said plurality of third panel apertures being positioned adjacent a first end of said third panel, each of said plurality of third panel apertures being aligned with an associated one of said apertures of said spacer member and an associated one of said plurality of slots of said first panel; and a plurality of connection apparati, each of said connection apparati being received by an associated one of said plurality of apertures and third panel apertures and an associated one of said plurality of slots in said first panel, said connection apparati providing a clamping force between said first panel and said third panel through said spacer member.

2. The support assembly of claim 1, further comprising:

a pair of hinges, said hinges having a first portion and a second portion, said first portion being coupled to a top surface of said coupling edge of said first panel;

said second portion being coupled to a top surface of said second panel; and said pair of hinges being for pivotally coupling said first panel and said second panel.

3. The support assembly of claim 1, further comprising:

wherein said connection apparati comprising a threaded member and a nut member;

said threaded member having a head portion and a shaft portion, said threaded member being insertable in and associated one of said third panel apertures, an associated one of said apertures of said spacer member and an associated one of said plurality of said slots, said head portion having a diameter larger than each of said third panel apertures, said head portion supporting said shaft portion when said threaded member being received by said apertures, said threaded member having an exterior surface with threads thereon; and said nut member having an perimeter wall with an aperture extending therethrough, said aperture having threads applied thereto, said nut member being for selectively capturing said threaded member in an associated pairing of aperture and third panel aperture.

4. The support assembly of claim 1, further comprising:

a pad member, said pad member being positioned on a top surface of said first panel adjacent a first end, said pad member being adapted for providing an actuation surface for a mouse type input device.

5. The support assembly of claim 1, further comprising:

wherein said first panel having a length of approximately 26 inches, said second panel having a length of approximately 10 inches, said third panel having a length of approximately 10 inches, said third panel being positioned substantially 2.5 inches above said first panel.

6. A support assembly comprising:

a first panel, said first panel having a mounting edge and a coupling edge, said first panel having a plurality of slots;

a second panel, said second panel being hingably coupled to said coupling edge of said first panel such that the second panel can be folded on top of the first panel and below the third panel, said second panel being an extension for said first panel;

a third panel, said third panel being positioned in a spaced generally parallel relationship with said first panel such that said support assembly engaging a worktop;

a pair of hinges, said hinges having a first portion and a second portion, said first portion being coupled to a top surface of said coupling edge of said first panel;

said second portion being coupled to a top surface of said second panel;

said pair of hinges being for pivotally coupling said first panel and said second panel;

a spacer member, said spacer member resting upon an medial portion of said first panel;

said spacer member having a plurality of apertures;

said third panel having a plurality of third panel apertures, each of said plurality of third panel apertures being positioned adjacent a first end of said third panel, each of said plurality of third panel apertures being aligned with an associated one of apertures of said spacer member and an asociated one of said plurality of slots of said first panel;

a plurality of connection apparati, each of said connection apparati being received by an associated one of said plurality of apertures and third panel apertures and an associated one of said a plurality of slots in said first panel, said connection apparati providing a clamping force between said first panel and said third panel through said spacer member;

wherein said connection apparati comprising a threaded member and a nut member;

said threaded member having a head portion and a shaft portion, said threaded member being insertable in and associated one of said third panel apertures, an associated one of said apertures of said spacer member, said head portion having a diameter larger than each of said third panel apertures, said head portion supporting said shaft portion when said threaded member being received by said apertures, said threaded member having an exterior surface with threads thereon;

said nut member having an perimeter wall with an aperture extending therethrough, said aperture having threads applied thereto, said nut member being for selectively capturing said threaded member in an associated pairing of aperture, third panel aperture, and slot;

a pad member, said pad member being positioned on a top surface of said first panel adjacent a first end, said pad member being adapted for providing an actuation surface for a mouse type input device;

wherein said first panel having a length of approximately 26 inches, said second panel having a length of approximately 10 inches, said third panel having a length of approximately 10 inches, said third panel being positioned substantially 2.5 inches above said first panel.

* * * * *